US006070355A

United States Patent [19]

Day

[11] Patent Number: 6,070,355

[45] Date of Patent: Jun. 6, 2000

[54] VIDEO SCOPE

[76] Inventor: Frederick A. Day, R.D. #3, Reynoldsville, Pa. 15851

[21] Appl. No.: 09/074,088

[22] Filed: May 7, 1998

[51] Int. Cl.[7] ..... F41C 27/00; G02B 23/10

[52] U.S. Cl. ..... 42/106; 89/41.05

[58] Field of Search ..... 89/41.05, 41.19, 89/41.01; 42/100, 106

[56] References Cited

U.S. PATENT DOCUMENTS

| | | | |
|---|---|---|---|
| 4,309,095 | 1/1982 | Buckley | 354/81 |
| 4,835,621 | 5/1989 | Black | 358/335 |
| 4,884,137 | 11/1989 | Hanson et al. | 358/108 |
| 4,922,801 | 5/1990 | Jaquard et al. | 89/41.05 |
| 4,936,190 | 6/1990 | Pilcher, II | 89/41.05 |
| 4,970,589 | 11/1990 | Hanson et al. | 358/108 |
| 5,020,262 | 6/1991 | Pena | 42/106 |
| 5,026,158 | 6/1991 | Golubic | 356/252 |
| 5,834,676 | 11/1998 | Elliott | 89/41.05 |
| 5,887,375 | 3/1999 | Watson | 42/106 |

*Primary Examiner*—Charles T. Jordan
*Assistant Examiner*—Denise L Buckley

[57] ABSTRACT

A gun-mounted video camera is provided including a gun. Also included is a video camera connected to the gun for accepting video images of a target of the gun.

2 Claims, 3 Drawing Sheets

VIDEO SCOPE

BACKGROUND OF THE INVENTION

1. Field of the Invention

The present invention relates to rifle scopes and more particularly pertains to a new video scope for viewing and recording a target in real time while hunting.

2. Description of the Prior Art

The use of rifle scopes is known in the prior art. More specifically, rifle scopes heretofore devised and utilized are known to consist basically of familiar, expected and obvious structural configurations, notwithstanding the myriad of designs encompassed by the crowded prior art which have been developed for the fulfillment of countless objectives and requirements.

Known prior art rifle scopes include U. S. Pat. No. 5,287,644; U.S. Pat. No. 4,290,219; U.S. Pat. No. Des. 332,457; U.S. Pat. No. 4,989,024; U.S. Pat. No. 4,202,115; and U.S. Pat. No. 4,907,022.

In these respects, the video scope according to the present invention substantially departs from the conventional concepts and designs of the prior art, and in so doing provides an apparatus primarily developed for the purpose of viewing and recording a target in real time while hunting.

SUMMARY OF THE INVENTION

In view of the foregoing disadvantages inherent in the known types of rifle scopes now present in the prior art, the present invention provides a new video scope construction wherein the same can be utilized for viewing and recording a target in real time while hunting.

The general purpose of the present invention, which will be described subsequently in greater detail, is to provide a new video scope apparatus and method which has many of the advantages of the rifle scopes mentioned heretofore and many novel features that result in a new video scope which is not anticipated, rendered obvious, suggested, or even implied by any of the prior art rifle scopes, either alone or in any combination thereof.

To attain this, the present invention generally comprises a rifle having a barrel, an intermediate extent and a butt. The rifle has a scope mounted atop a rear of the intermediate extent at a first elevation for aiming the rifle. Next provided is a viewing assembly with a cylindrical configuration having a rear portion with a first length and a first diameter. The rear portion includes a fiber optic cable mounted therein which extends from an inboard end of the viewing assembly. The viewing assembly further includes a front portion with a second length ½ that of the first length and a second diameter twice that of the first diameter. The front portion includes a cross-hair and a magnifying lens. Together, the cross-hair and magnifying lens function for augmenting the video images entering the outboard end of the viewing assembly and further including an image of the cross-hair. Next provided is a viewing assembly mount including a pair of U-shaped resilient clamps each mounted at an apex thereof in tangential relationship with the viewing assembly. The clamps are removably coupled to the barrel of the rifle such that the viewing assembly is secured on the rifle at a second elevation less than the first elevation. A real time video camera is included having a rectangular configuration. The video camera includes a recorder that is connected to the fiber optic cable for recording the video images received via the viewing assembly. Also included is a display connected to the fiber optic cable for viewing the video images in real time in a first mode of operation. In a second mode of operation, a playback of previously recorded video images may be viewed on the display. FIGS. 4A & 4B show a hinge having a first end connected to a central extent of the rear portion of the viewing assembly. A second end of the hinge is removably coupled to a lower edge of the video camera for selectively viewing the video images in real time while the rifle is being held in a conventional manner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new video scope apparatus and method which has many of the advantages of the rifle scopes mentioned heretofore and many novel features that result in a new video scope which is not anticipated, rendered obvious, suggested, or even implied by any of the prior art rifle scopes, either alone or in any combination thereof.

It is another object of the present invention to provide a new video scope which may be easily and efficiently manufactured and marketed.

It is a further object of the present invention to provide a new video scope which is of a durable and reliable construction.

An even further object of the present invention is to provide a new video scope which is susceptible of a low cost of manufacture with regard to both materials and labor, and which accordingly is then susceptible of low prices of sale to the consuming public, thereby making such video scope economically available to the buying public.

Still yet another object of the present invention is to provide a new video scope which provides in the apparatuses and methods of the prior art some of the advantages thereof, while simultaneously overcoming some of the disadvantages normally associated therewith.

Still another object of the present invention is to provide a new video scope for viewing and recording a target in real time while hunting.

Even still another object of the present invention is to provide a new video scope that includes a gun. Also included is a video camera connected to the gun for accepting video images of a target of the gun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
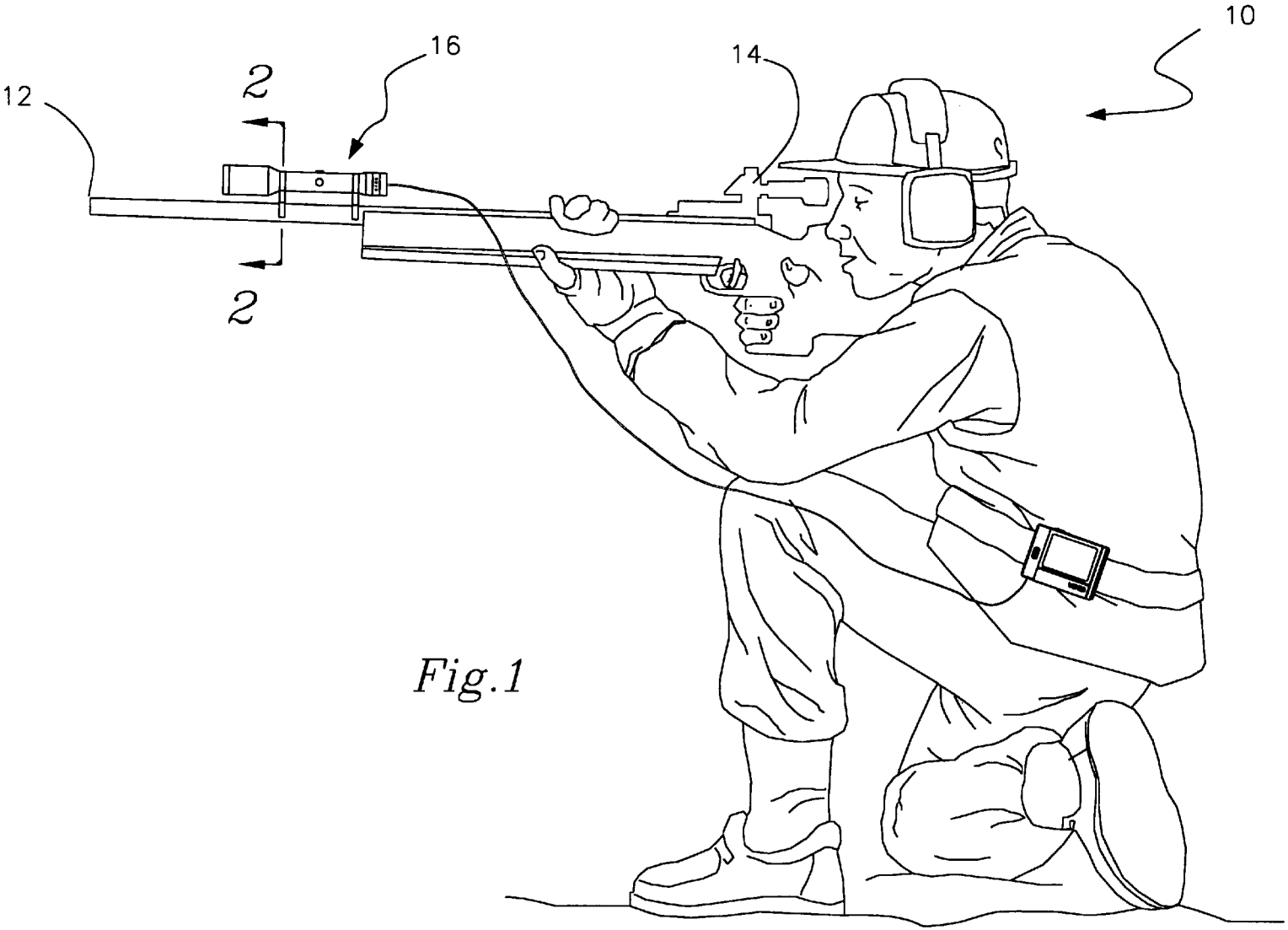
FIG. 1 is a side view of a new video scope according to the present invention.
Figure 3:
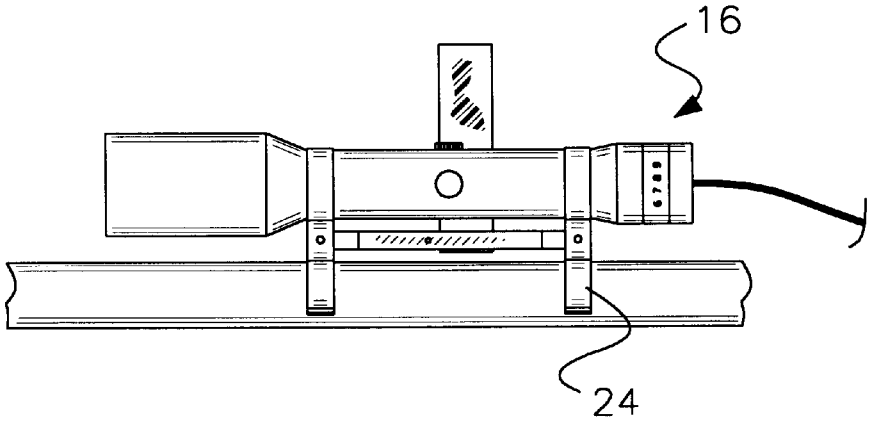
FIG. 3 is a side view of the present invention rotated 90 degrees.

With reference now to the drawings, and in particular to FIGS. 1 through 5 thereof, a new video scope embodying the principles and concepts of the present invention and generally designated by the reference numeral 10 will be described.

The present invention, designated as numeral 10, includes a rifle 12 having a barrel, an intermediate extent and a butt. The rifle has a scope 14 mounted atop a rear of the intermediate extent at a first elevation for aiming the rifle.

Next provided is a viewing assembly 16 with a cylindrical configuration having a rear portion 18 with a first length and a first diameter. The rear portion includes an elongated fiber optic cable 20 mounted therein which extends from an inboard end of the viewing assembly.

The viewing assembly further includes a front portion 22 with a second length ½ that of the first length and a second diameter twice that of the first diameter. The front portion includes a cross-hair and a magnifying lens. Together, the cross-hair and magnifying lens function for augmenting video images entering the outboard end of the viewing assembly and further including an image of the cross-hair.

Figure 2B:
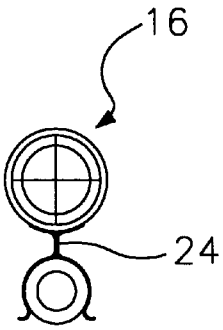
FIGS. 2A & B are front views of the removable nature of the viewing assembly of the present invention.
Figure 2A:
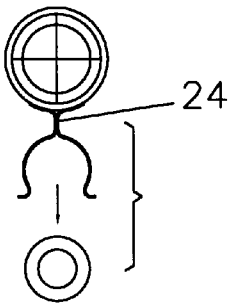

Next provided is a viewing assembly mount 24 including a pair of U-shaped resilient clamps each mounted at an apex thereof in tangential relationship with the viewing assembly. As shown in FIGS. 2A & B, ends of the clamps are out turned. The clamps are removably coupled to a front of the barrel of the rifle such that the viewing assembly is secured on the rifle at a second elevation less than the first elevation.

A real time video camera 26 is included having a rectangular configuration. The video camera includes a recorder that is connected to the fiber optic cable for recording the video images received via the viewing assembly. Also included is a display 28 connected to the fiber optic cable for viewing the video images in real time in a first mode of operation. In a second mode of operation, a playback of previously recorded video images may be viewed on the display. As such, the video camera may be equipped with features that are commonly employed in the art of video cassette recorders.

Figure 4B:
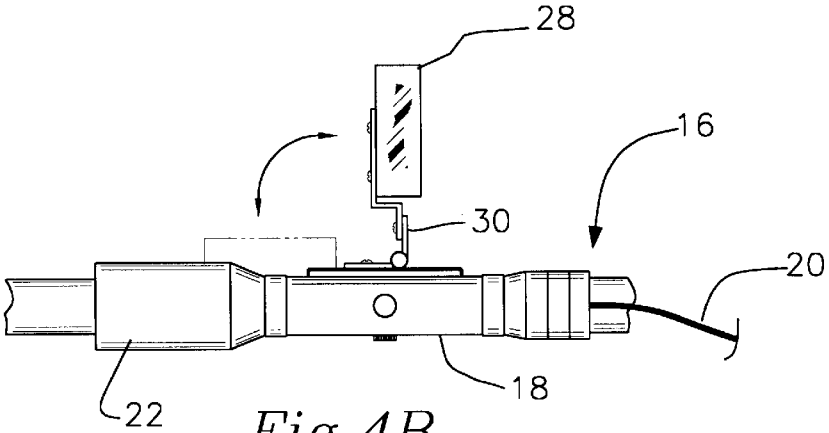
FIGS. 4A & B are a side views of the hingable coupling between the video camera and viewing assembly of the present invention.
Figure 5:
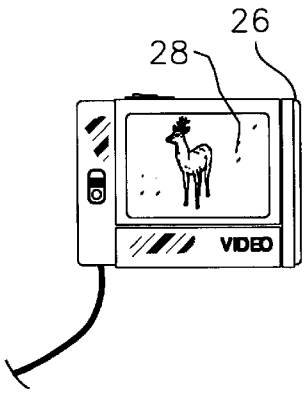
FIG. 5 is a front view of the video camera of the present invention.
Figure 4A:
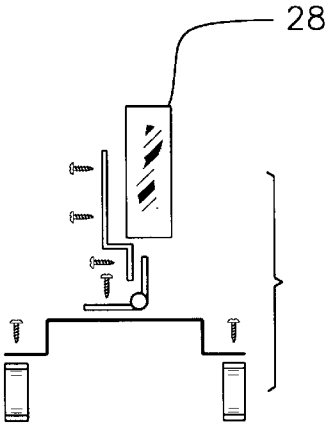

FIGS. 4A & 4B show a hinge 30 having a first end connected to a central extent of the rear portion of the viewing assembly and offset from the U-shaped clamps by 90 degrees. A second end of the hinge is removably coupled to a lower edge of the video camera for selectively viewing the video images in real time while the rifle is being held in a conventional manner. As shown in FIGS. 4A & 4B, a bracket is mounted on the video camera which is in turn screwably coupled to the second end of the hinge.

In use, the camera is pivotable between a first orientation situated against the viewing assembly and a second orientation in perpendicular relationship with respect to the viewing assembly. In an alternate use, the video camera may be removed and clipped to an article of clothing of a user. Note FIG. 1. The present invention may thus be used to simulate hunting with blanks and further record video images of hunting.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gun-mounted video camera system comprising, in combination:

a rifle including a barrel, an intermediate extent and a butt, the rifle having a scope mounted atop a rear of the intermediate extent at a first elevation for aiming the rifle;

a viewing assembly with a cylindrical configuration having a rear portion with a first length and a first diameter, the rear portion including a fiber optic cable mounted therein and extending from an inboard end of the viewing assembly, the viewing assembly further including a front portion with a second length ½ that of the first length and a second diameter twice that of the first diameter, the front portion including a cross-hair and a magnifying lens for augmenting the video images entering the outboard end of the viewing assembly and further including an image of the cross-hair;

a viewing assembly mount including a pair of U-shaped resilient clamps each mounted at an apex thereof in tangential relationship with the viewing assembly, wherein the clamps are removably coupled to the barrel of the rifle such that the viewing assembly is secured on the rifle at a second elevation less than the first elevation;

a real time video camera having a rectangular configuration and including a recorder connected to the fiber optic cable for recording the video images received via the viewing assembly and a display connected to the fiber optic cable for viewing the video images in real time in a first mode of operation and further viewing a playback of previously recorded video images in a second mode of operation; and a hinge having a first end connected to a central extent of the rear portion of the viewing assembly on a side opposite that of the clamps and a second end removably coupled to a lower edge of the video camera for selectively viewing the video images in real time while the rifle is being held in a conventional manner.

2. A gun-mounted video camera system comprising:

a gun; and a video camera connected to the gun for accepting video images of a target of the gun, wherein the video camera includes a lens mounted on the gun and a display, the display being hingably coupled to the gun;

wherein the video camera is removably coupled to the gun;

wherein the display is removably coupled to the gun; and wherein the video camera includes a lens mounted on the gun and a recorder.

* * * * *